US010105741B2

(12) United States Patent
Erker et al.

(10) Patent No.: US 10,105,741 B2
(45) Date of Patent: Oct. 23, 2018

(54) STEERABLE ROLLER HEMMING HEAD

(71) Applicant: HIROTEC AMERICA, Inc., Auburn Hills, MI (US)

(72) Inventors: Gerald F. Erker, Clarkston, MI (US); Justin T. Hester, Clarkston, MI (US); Gary T. Krus, Oakland Township, MI (US)

(73) Assignee: HIROTEC AMERICA, INC., Auburn Hills, MI (US)

( * ) Notice: Subject to any disclaimer, the term of this patent is extended or adjusted under 35 U.S.C. 154(b) by 289 days.

(21) Appl. No.: 15/070,159

(22) Filed: Mar. 15, 2016

(65) Prior Publication Data

US 2016/0279691 A1 Sep. 29, 2016

Related U.S. Application Data

(60) Provisional application No. 62/136,668, filed on Mar. 23, 2015.

(51) Int. Cl.
*B21D 19/04* (2006.01)
*B21D 39/02* (2006.01)

(52) U.S. Cl.
CPC ..... *B21D 19/043* (2013.01); *B21D 39/023* (2013.01); *Y10S 901/41* (2013.01)

(58) Field of Classification Search
CPC ..... B21D 19/04; B21D 19/043; B21D 39/023
See application file for complete search history.

(56) References Cited

U.S. PATENT DOCUMENTS 5,228,190 A 7/1993 Sawa
7,637,134 B2 * 12/2009 Burzlaff ..... B21D 39/021 29/243.58

(Continued)

FOREIGN PATENT DOCUMENTS

DE 102010051771 A1 * 6/2012 ..... B21D 19/043
JP 61262432 A * 11/1986

(Continued)

OTHER PUBLICATIONS

Merged document with English translation of Abstract for DE 102010051771 A1 to Priss is attached.*

(Continued)

*Primary Examiner* — Peter DungBa Vo
*Assistant Examiner* — John S Lowe
(74) *Attorney, Agent, or Firm* — Robert P. Michal, Esq.; Carter, DeLuca, Farrell & Schmidt, LLP

(57) ABSTRACT

A steering roller head for hemming or seaming metal sheets includes a mounting flange that couples to an arm of a robot. The mounting flange is offset from a longitudinal axis of the steering roller head to reduce an operating envelope of the robot arm during a roller hemming process. The mounting flange can also be offset by a mounting angle from the longitudinal axis which allows for a further reduction in an operating envelope of the robot arm during a roller hemming process. Reducing the operating envelope of the robot arm can allow for additional robots or automated tooling to access the work piece during a roller hemming process. In addition, reducing the operating envelope of the robot arm allows for improved access to the work piece during a roller hemming process.

19 Claims, 8 Drawing Sheets

(56) References Cited

U.S. PATENT DOCUMENTS

| | | | | |
|---|---|---|---|---|
| 8,024,950 | B2 * | 9/2011 | Harrow | B21D 39/021 29/243.57 |
| 2008/0092618 | A1 | 4/2008 | Hasegawa et al. | |
| 2008/0256779 | A1 | 10/2008 | Ryu et al. | |
| 2010/0242561 | A1 | 9/2010 | Reith et al. | |

FOREIGN PATENT DOCUMENTS

| | | | |
|---|---|---|---|
| JP | 1990-229679 | A | 9/1990 |
| JP | 2003-071569 | A | 3/2003 |
| JP | 2005-193298 | A | 7/2005 |
| JP | 2005-216622 | A | 8/2005 |
| JP | 2007-130659 | A | 5/2007 |
| JP | 2008-100272 | A | 5/2008 |
| JP | 2008-264824 | A | 11/2008 |
| JP | 2010-528864 | A | 8/2010 |
| JP | 2010-194568 | A | 9/2010 |

OTHER PUBLICATIONS

Machine translation for DE 102010051771 A1 to Priss is attached.*
Merged document with English translation of Abstract for JP 61262432 A to Sawa et al. is attached.*
Machine translation for JP 61262432 A to Sawa et al. is attached.*
Decision to Grant a Patent issued by the Japanese Patent Office in relation to Japanese Patent Application No. 2016-557265 dated Apr. 7, 2017 (3 pages) with English translation (3 pages).
International Preliminary Report on Patentablity issued by the International Bureau of WIPO in relation to International Application No. PCT/US2016/022529 dated Sep. 26, 2017 (1 page).
Written Opinion of the International Searching Authority issued by the Japanese Patent Office acting as the International Searching Authority dated Jun. 21, 2016 (4 pages).
International Search Report and Written Opinion for corresponding International Application No. PCT/US2016/022529 dated Jun. 21, 2016. (8 pages).

* cited by examiner

STEERABLE ROLLER HEMMING HEAD

CROSS-REFERENCE TO RELATED APPLICATION

This application claims the benefit under 35 U.S.C. § 119(e) of, and priority to, U.S. Provisional Patent Application Ser. No. 62/136,668, filed Mar. 23, 2015, the entire contents of which is hereby incorporated by reference.

BACKGROUND

1. Technical Field

The present disclosure relates to robotic roller hemming and seaming, and more specifically, to steerable roller hemming heads for robotic roller hemming.

2. Background Information

A roller hemming process can be used to join two metal sheets together to form a work piece. For example, two metal sheets can be joined to form a door panel or the like for an automobile. During a typical roller hemming process, a peripheral edge of an outer sheet of the two metal sheets is vertically bent along the entire circumference thereof and then the outer sheet is fixed to a mold. Then, an inner sheet is stacked on the outer sheet. With the two sheets stacked on top of one another, the two sheets are joined by pressing a roller head against the peripheral edge of the outer sheet to fold or hem the two sheets together. The roller head can be attached to an arm of a robot that moves the roller head about the work piece to hem the sheets together. The processing quality or the shape of a bent work piece depends on the positional accuracy of the robot manipulator, since the roller is moved by the robot.

While the arm of the robot is moving the roller head about the work piece within an operating envelope, other robots or automated tooling may be interacting or performing processes on the work piece (e.g., roller hemming, roller flanging, pre-hemming, pre-corner hemming, welding, drilling, milling, riveting, applying fasteners, etc.). The size of the operating envelope restricts access to the work piece to avoid interference between the robots and automated tooling.

There is a continuing need for improved roller heads that increase the quality and/or speed of the roller hemming process. In addition, there is a continuing need for improved roller heads that reduce the size of the operating envelope to allow additional robots to access a work piece during the roller hemming process.

SUMMARY

This disclosure relates generally to a steering roller head for hemming or seaming metal sheets. The steering roller head includes a mounting flange that couples to an arm of a robot. The mounting flange is offset from a longitudinal axis of the steering roller head which reduces an operating envelope the robot arm during a roller hemming process. The mounting flange can also be offset by a mounting angle from the longitudinal axis which allows for a further reduction in an operating envelope of the robot arm during a roller hemming process. Reducing the operating envelope of the robot arm can allow for additional robots to access the work piece during a roller hemming process. In addition, reducing the operating envelope of the robot arm allows for improved access to the work piece during a roller hemming process.

In accordance with aspects of the present disclosure, a steering roller head includes a housing, a motor, and a roller package. The housing defines a longitudinal axis of the steering roller head. The motor is mounted within the housing and includes a drive shaft. The roller package is operably associated with the motor such that rotation of the drive shaft affects rotation of the roller package about the longitudinal axis of the steering roller head.

In aspects, the steering roller head includes a mounting flange that is operably coupled to the housing. The mounting flange can be offset from the longitudinal axis. The mounting flange can include a mounting surface that defines a mounting plane. The mounting plane can define a mounting angle with the longitudinal axis. The mounting angle can be in a range of about 30° to about 60°. The mounting flange can be laterally offset from the longitudinal axis.

In some aspects, the steering roller head includes a biasing unit. The mounting flange can be attached to the biasing unit and the biasing unit can be attached to the housing to operably couple the mounting flange to the housing. The steering roller head can have a push configuration in which the biasing unit urges the roller package in a direction away from the housing along the longitudinal axis. The steering roller head can have a pull configuration in which the biasing unit urges the roller package in a direction towards the housing along the longitudinal axis.

In certain aspects, the biasing unit includes longitudinal guides and a slidable insert that houses the longitudinal guides. The insert is disposed between the top and the base plates of the housing. The biasing unit can include a stop surface that abuts the top plate to arrest movement of the biasing unit parallel to the longitudinal axis in the push configuration and that abuts the base plate to arrest movement of the biasing unit parallel to the longitudinal axis in the pull configuration. The biasing unit can include springs. In the push configuration, the insert can be orientated to position the springs between the insert and the base plate. In the pull configuration, the insert can be orientated to position the springs between the insert and the top plate. The insert can define holes that receive the springs and can be reversible to change the configuration of the steering roller head.

In particular aspects, the steering roller head includes a gearbox that is secured to the housing. The gearbox can receive input from the drive shaft of the motor and include an output shaft that is rotatably fixed to the roller package. The gearbox can be configured to resist axial and transverse forces experienced by the roller package during roller hemming.

In aspects, the housing provides mounting for the guide shafts, the gearbox, homing guide, and a motor guard. The motor guard can mount to the top plate of the housing. The motor guard can provide strain relief for cables interconnecting the motor and a controller.

In another aspect of the present disclosure, a robot for roller hemming includes a base, an arm, and a steering roller head. The arm includes first and second links. The first link is operably coupled to the base and the second link is operably associated with the first link. The second link includes a tool coupler. The steering roller head is coupled to the tool coupler and includes a housing, a motor, and a roller package. The housing defines a longitudinal axis of the steering roller head. The motor is mounted within the housing and includes a drive shaft. The roller package is operably associated with the motor. Rotation of the drive shaft rotates the roller package about the longitudinal axis of the steering roller head.

In aspects, the robot is a multi-axis robot including a plurality of articulating joints with the final joint being the tool coupler.

In some aspects, the arm is configured to move the steering roller head in six degrees of freedom. The motor may be configured to rotate the roller package in a seventh degree of freedom. The robot may include a robot controller that is configured to control movement of the arm and the motor may include a motor controller that is configured to control rotation of the roller package relative to the housing. The motor controller can be integrated with the robot controller.

Further, to the extent consistent, any of the aspects described herein may be used in conjunction with any or all of the other aspects described herein.

BRIEF DESCRIPTION OF THE DRAWINGS

Various aspects of the present disclosure are described hereinbelow with reference to the drawings, which are incorporated in and constitute a part of this specification, wherein.

DETAILED DESCRIPTION

Figure 1:
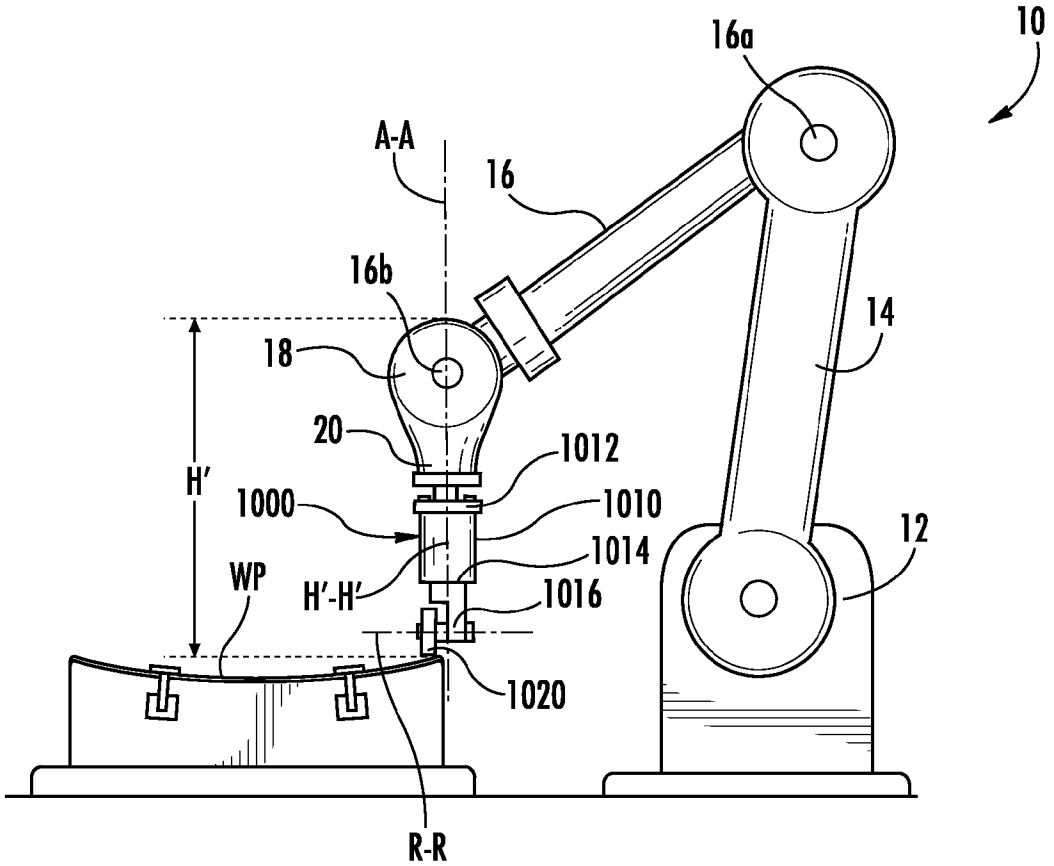
FIG. 1 PRIOR ART
FIG. 1 is a perspective view of a prior art roller head coupled to an arm of a robot.

Referring now to FIG. 1, a prior art roller head 1000 is shown coupled to a robot arm 10. As shown the robot arm 10 includes a robot base 12 and three links 14, 16, and 18 that are moveable about six axis of rotation. The first link 14 is attached to the robot base 12 that can be fixed or moveable. The third link 18 supports a tool coupler 20 that couples to the roller head 1000. The second link 16 is pivotally coupled on a first end 16*a* to the first link 14 and at a second end 16*b* to the third link 18. The third link 18 defines an arm axis A-A that passes through the second end 16*b* of the second link 16 and through the tool coupler 20.

The roller head 1000 includes a housing 1010 and a roller 1020. The housing 1010 includes a first end 1012 that releasably couples to the tool coupler 20 and a second end 1014 that includes a roller mount 1016 which rotatably supports the roller 1020. The housing 1010 defines an axis H'-H' that passes through the first and second ends 1012, 1014. The roller mount 1016 supports the roller 1020 such that the roller 1020 rotates about an axis R-R that is orthogonal to the axis H'-H'.

By aligning the axis H'-H' of the housing 1010 with the axis A-A of the third link 18 of the robot arm 10, rotation of the third link 18 about the axis A-A rotates the housing 1010 and the roller 1020 about the axis H'-H'. This alignment requires the third link 18 of the robot arm 10 to be positioned over the first end 1012 of the housing 1010 which increases the clearance required over the work piece during a roller hemming process. This clearance defines an operating envelope of the robot arm 10 during a roller hemming process which limits access of other robots to a work piece WP during a roller hemming process.

As detailed herein, a steering roller head in accordance with the present disclosure includes a mounting flange that is laterally offset from a longitudinal axis of the steering roller head. In addition, the mounting flange can define a mounting plane that is offset from the longitudinal axis by a mounting angle. Offsetting the mounting flange from the longitudinal axis reduces a height and length of an operating envelope of a robot arm that manipulates the steering roller head during a roller hemming process.

During a roller hemming process, a motor of the steering roller head rotates a roller package about the longitudinal axis of the steering roller head as the robot arm moves the steering roller head about a work piece. The motor allows for increased control of the steering roller head and reduces movement of the robot arm required to track seams of the work piece when compared to the prior art roller head 1000.

Embodiments of the present disclosure are now described in detail with reference to the drawings in which like reference numerals designate identical or corresponding elements in each of the several views.

Referring now to FIGS. 2-5, a steering roller head 100 in accordance with the present disclosure is coupled to the tool coupler 20 of the robot arm 10. The steering roller head 100 includes a mounting flange 110, a compliant or biasing unit 120, a housing 130, a motor 150, and a roller package 160. The housing 130 defines a longitudinal or housing axis H-H of the steering roller head 100 that passes through the roller package 160 and the motor 150. The housing includes a top plate 132, a base plate 134, side plates 138, and guide shafts 126*a*.

Figure 2:
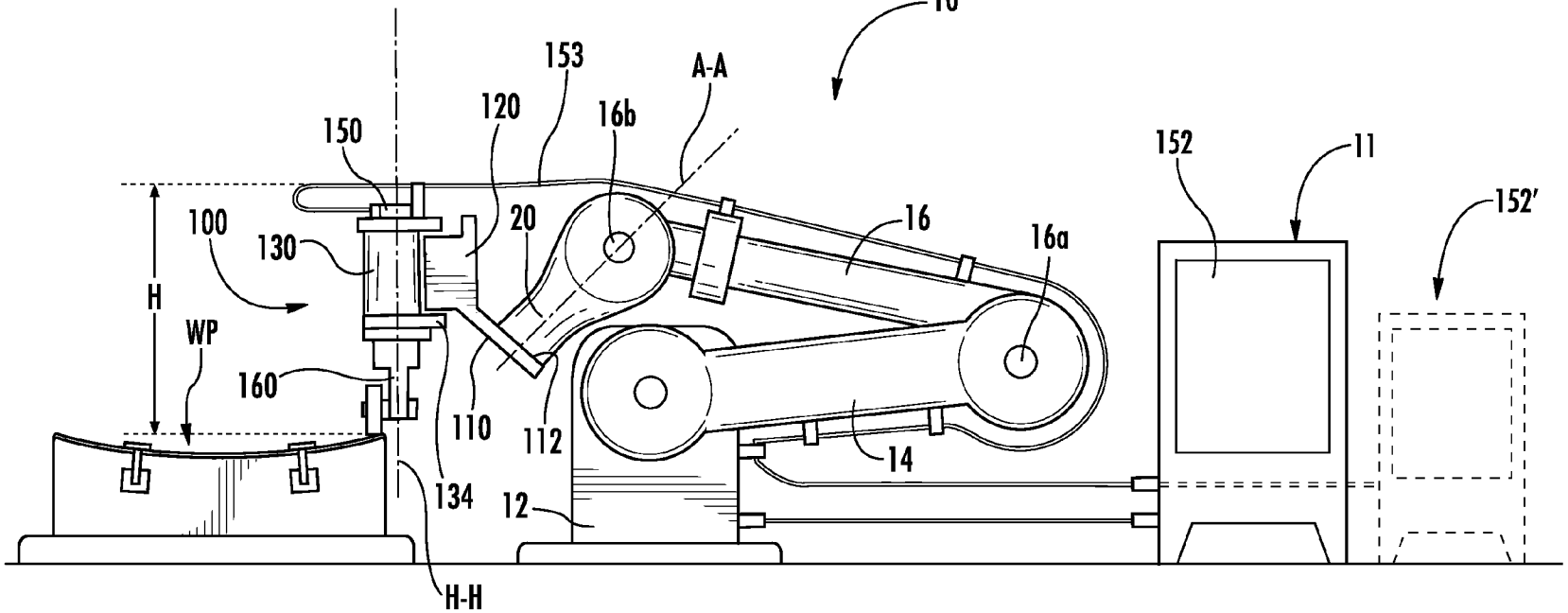
FIG. 2 is a perspective view of a steering roller head in accordance with the present disclosure coupled to the arm of the robot of FIG. 1.

With particular reference to FIG. 2, the mounting flange 110 includes a mounting surface 112. The tool coupler 20 of the robot arm 10 is releasably coupled to the mounting surface 112 with the mounting flange 110 attached to the biasing unit 120. The mounting flange 110 is positioned adjacent the base plate 134 of the housing 130 and is offset from the housing axis H-H such that the robot arm 10 extends from a side of the steering roller head 100.

Figure 5:
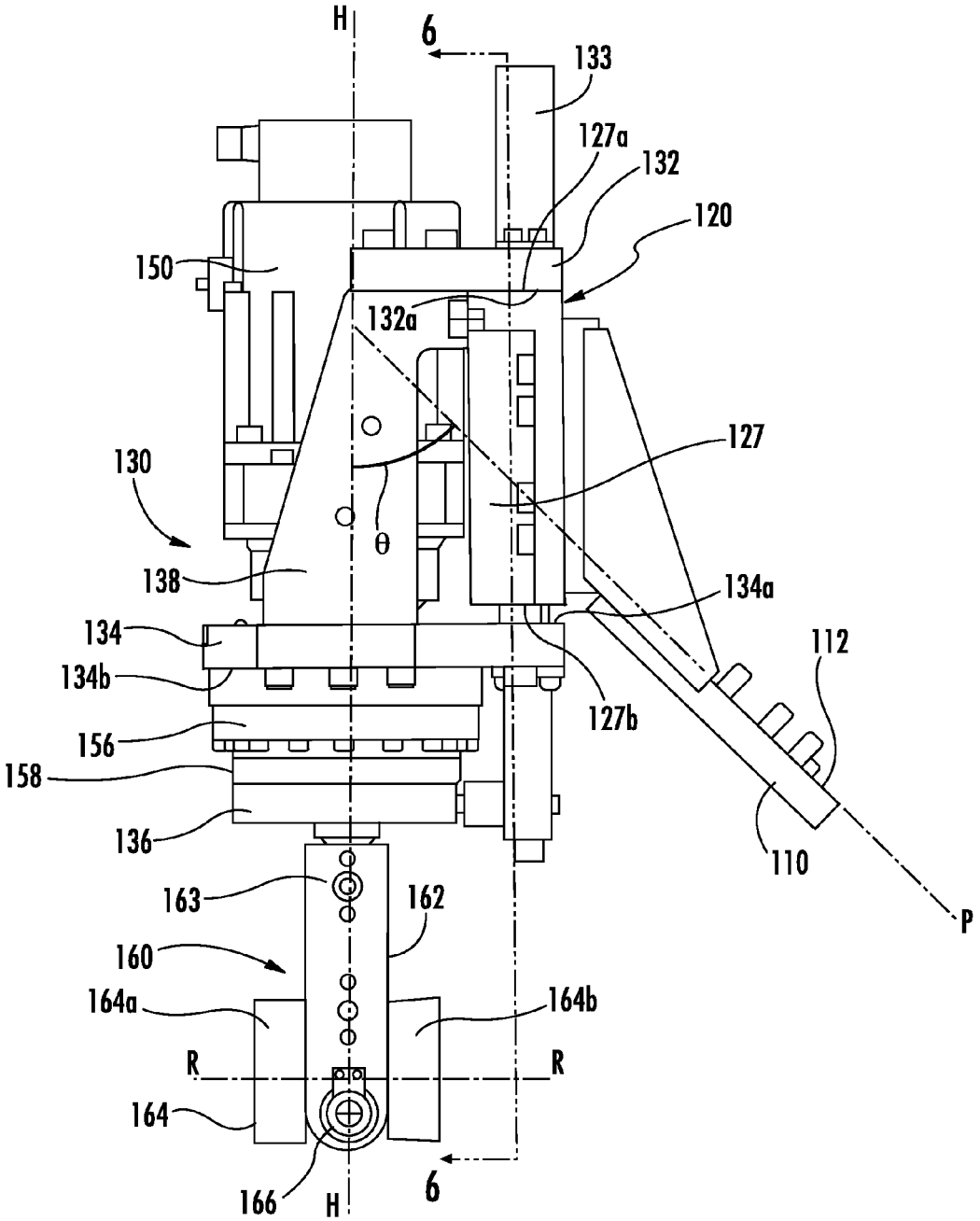
FIG. 5 is a side view of the steering roller head of FIG. 3 in a push configuration.

With particular reference referring to FIG. 5, the mounting surface 112 of mounting flange 110 defines a mounting plane P that defines a mounting angle θ with the housing axis H-H. As shown, the mounting angle θ is defined in a vertical plane with the housing axis H-H such that the tool coupler 20 (FIG. 2) of the robot arm 10 can be positioned above, below, or at the base plate 134 of the housing 130. It is contemplated that the mounting angle θ can be defined in a horizontal plane with the housing axis H-H such that the tool coupler 20 of the robot arm 10 can be in front of or behind the steering roller head 100. It is also contemplated that the mounting plane P can be defined in a vertical and horizontal plane such that the tool coupler 20 can be positioned above and in front of or below and behind the steering roller head 100 or a different combination of above, below, in front, or behind depending on the desired application. As shown, the mounting angle θ is about 45° in a vertical plane; however, it is contemplated that the mounting angle may be in a range of about 0° to about 90° in each of a vertical or a horizontal plane.

Referring briefly back to FIGS. 1 and 2, offsetting the mounting flange 110 from the housing axis H-H and defining the mounting angle θ between the mounting plane P and the housing axis H-H reduces a vertical height H of the robot arm 10 and the rolling head 100 above the work piece WP when compared to a vertical height H' of the robot arm 10 and the prior art roller head 1000 above the work piece WP. The reduction in height reduces an operating envelope or clearance defined by the robot arm 10 when manipulating the steering roller head 100 compared to an operating envelope defined by the robot arm 10 when manipulating the prior art roller head 1000 during a roller hemming process. Reducing an operating envelope of the robot arm 10 allows for higher density robot placement. The reduction in height can be in a range of about 40% to about 60% (e.g., about 50%).

It will be appreciated that offsetting the mounting flange 110 from the housing axis H-H no longer allows rotation of the third link 18 about the arm axis A-A to rotate the steering roller head 100 about the housing axis H-H to track seams of a work piece during a roller hemming process in a similar manner to the prior art roller head 1000.

Figure 3:
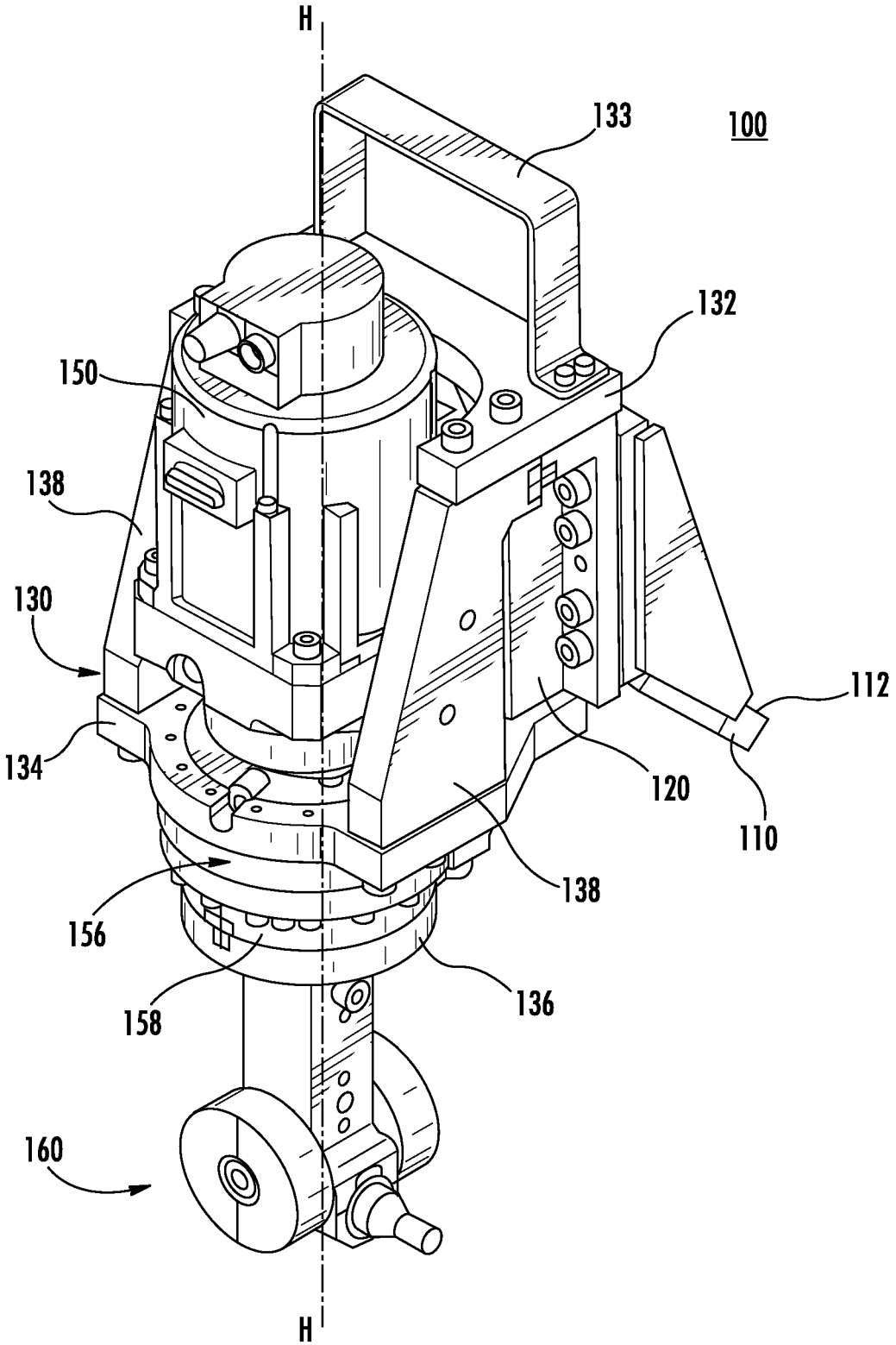
FIG. 3 is a perspective view of the steering roller head of FIG. 2.
Figure 4:
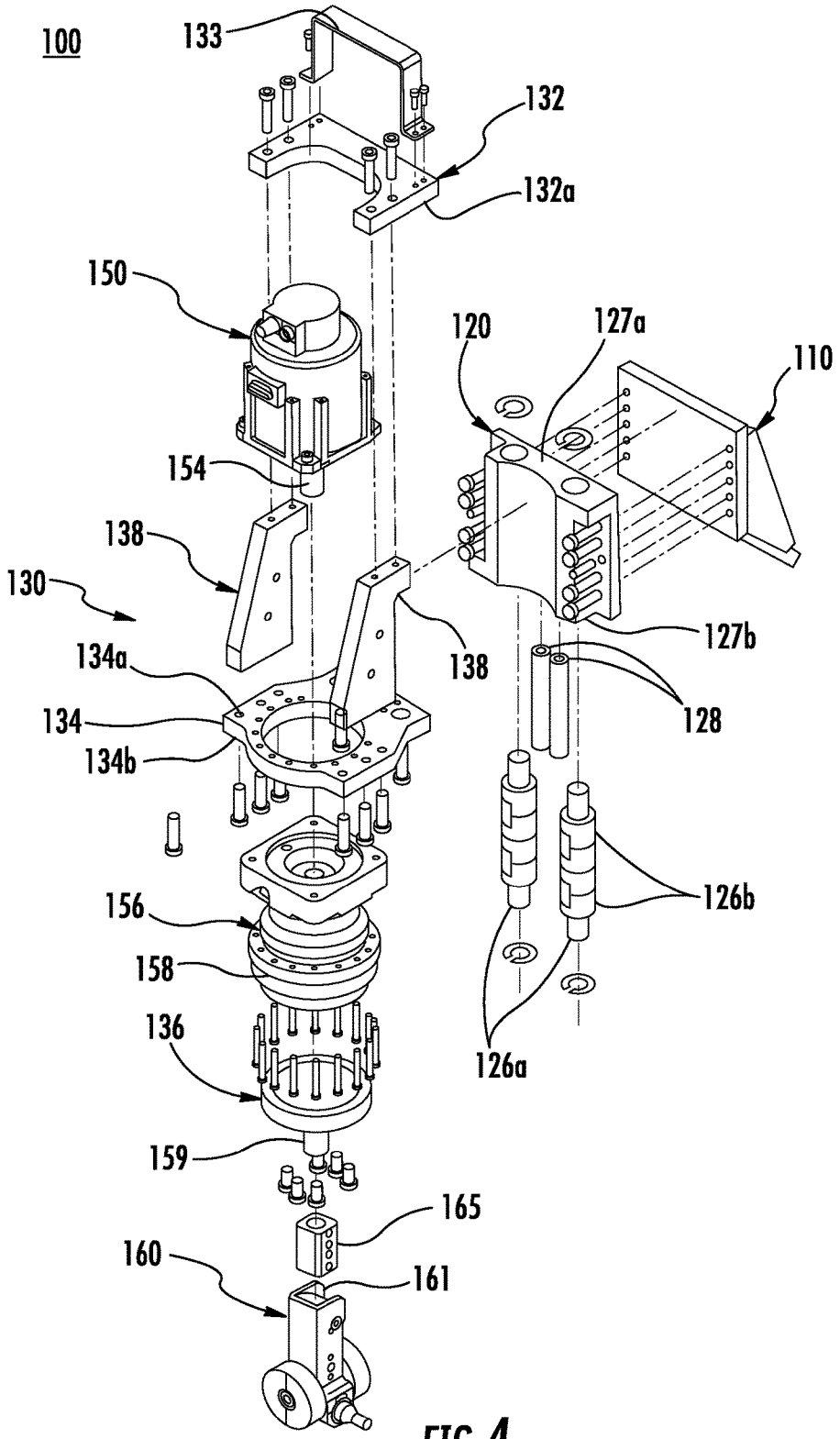
FIG. 4 is an exploded view, with parts separated, of the steering roller head of FIG. 3.

Referring to FIGS. 3 and 4, in order to allow the steering roller head 100 to track the seams of a work piece during a roller hemming process, the steering roller head 100 includes the motor 150 which is operably associated with the roller package 160 of the steering roller head 100 to rotate the roller package 160 about the housing axis H-H to track seams of a work piece during a roller hemming process. The motor 150 allows the robot arm 10 (FIG. 2) to maintain the orientation of the steering roller head 100 relative to the work piece while the motor 150 rotates the roller package 160 about the housing axis H-H as the robot arm 10 moves along seams of the work piece.

The motor 150 includes a controller 152 (FIG. 2) and a drive shaft 154. The motor 150 is positioned between the side plates 138 and is mounted to an upper surface 134*a* of the base plate 134 of the housing 130. The top plate 132 of the housing 130 is secured to the side plates 138 and may include a guard 133 that protects motor 150 from accidental contact with obstructions (e.g., other robot arms or work pieces) during a roller hemming process. The guard 133 can also function as an arrest or guide for cables 153 (FIG. 2) that interconnect the motor to the controller 152. The guard 133 can provide strain relieve for the cables 153.

The controller 152 is a motion control device that controls the motor 150 such that the roller package 160 is rotated about the housing axis H-H as the steering roller head 100 is moved about a work piece. The controller 152 can be part of a robot controller 11 of the robot arm 10 or the controller can be a standalone device as represented by controller 152' which is interconnected with the robot controller 11 in FIG. 2. It is envisioned that costs can be reduced by integrating the controller 152 into the robot controller 11. For example, the robot arm 10 may be moveable in six degrees-of-freedom (DOF), one degree for each axis of movement, and the motor 150 can control rotation of the roller package 160 in a seventh DOF (e.g., robot controller 11). In addition, integrating the controller 152 into the robot controller 11 can allow the robot arm 10 and the steering roller head 100 to function in a coordinated fashion. Further, the integration of the controller 152 into the robot controller 11 can allow for quicker cycle times of the robot arm 10, reduced interference with other robots, and improved communication, or handshakes, with other robots.

The steering roller head 100 can include a gearbox 156 that converts rotation of the drive shaft 154 into rotation of the of the roller package 160. The gear box 156 receives input from the drive shaft 154 and converts rotation of the drive shaft 154 into output via an output shaft 158. The output shaft 158 is rotatably fixed to the roller mounting plate 136. A mounting shaft 159 extends out from the roller mounting plate 136 along a longitudinal axis away from the housing 130. The mounting shaft 159 attaches the roller package 160 such that rotation of the output shaft 158 rotates the roller package 160 about the housing axis H-H. It is envisioned that the gear box 156 increases torque while decreasing angular velocity of input from the drive shaft 154 to rotation of the output shaft 158.

The gear box 156 can include a bearing package (not explicitly shown) that resists axial loads (i.e., loads along the housing axis H-H) and/or transverse loads (i.e., loads perpendicular to the housing axis H-H) experienced by the roller package 160 during a roller hemming process. It is contemplated that the bearing package can be located within the gear box 156, between the gear box 156 and the motor 150, and/or between the gear box 156 and the roller package 160.

As shown, the drive shaft 154 is disposed about the housing axis H-H. It is contemplated that when the steering roller head 100 includes the gearbox 156, the drive shaft 154 of the motor 150 can be offset from the housing axis H-H. For example, the drive shaft 154 can be coupled to a pinion within a gearbox (e.g., gearbox 156) that engages an inner surface of a ring gear that is rotatably fixed to the output shaft 158 disposed about the housing axis H-H to rotate the roller package 160 about the housing axis H-H.

Figure 6:
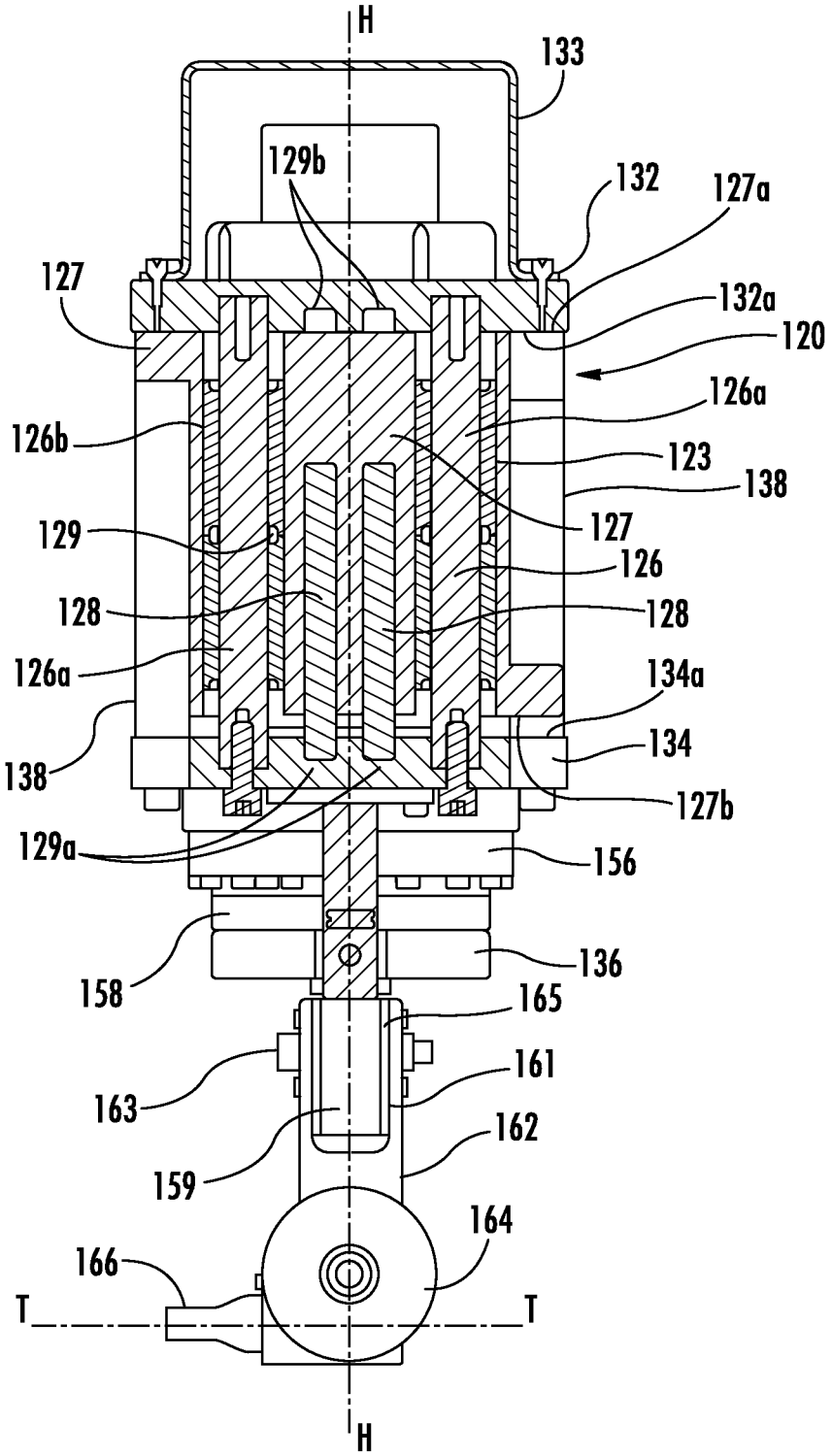
FIG. 6 is a cross-sectional view taken along the section line 6-6 of FIG. 5.

With reference to FIGS. 5 and 6, the roller package 160 includes a body 162, a first hemming head 164, and a second hemming head 166. The body 162 defines a channel 161 that receives the mounting shaft 159. The body 162 includes one or more connectors 163 that pass into the mounting shaft 159 to secure the body 162 to the mounting shaft 159. An adaptor 165 can be used as a transitional fit between the mounting shaft 159 and the channel 161 of the body 162. The first and second hemming heads 164, 166 are disposed at an end of the body 162 opposite the channel 161. The first hemming head 164 is rotatable about an axis R-R that is orthogonal to the housing axis H-H and the second hemming head defines an axis T-T that is orthogonal to the housing axis H-H and perpendicular to axis R-R. The first hemming head 164 includes first and second rollers 164*a*, 164*b* disposed on either side of the body 162 with the second hemming head 166 extending between the first and second rollers 164*a*, 164*b*. It is envisioned that the first hemming head 164 can include a single roller (e.g., first roller 164*a*).

Figure 7:
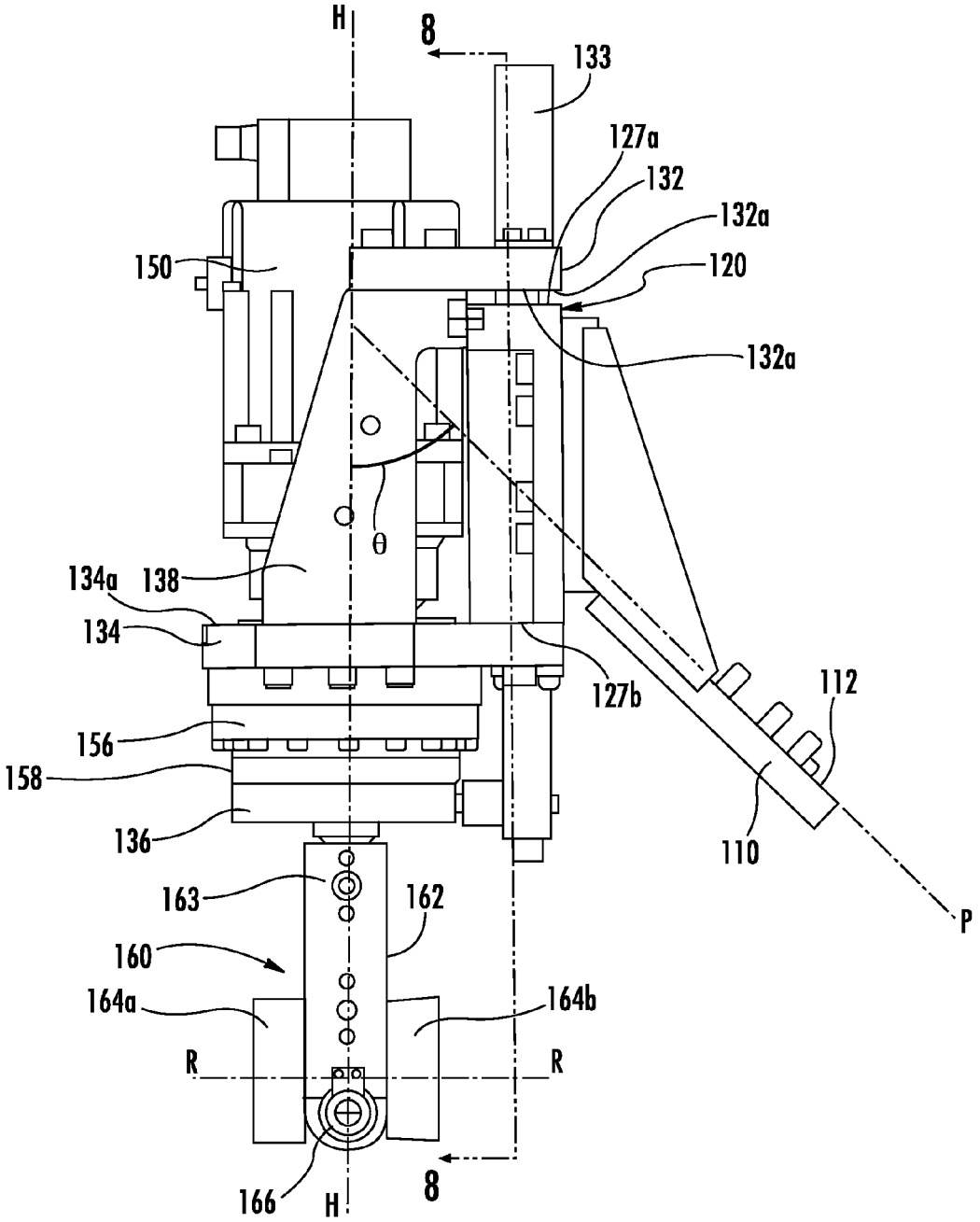
FIG. 7 is a side view of the steering roller head of FIG. 3 in a pull configuration.
Figure 8:
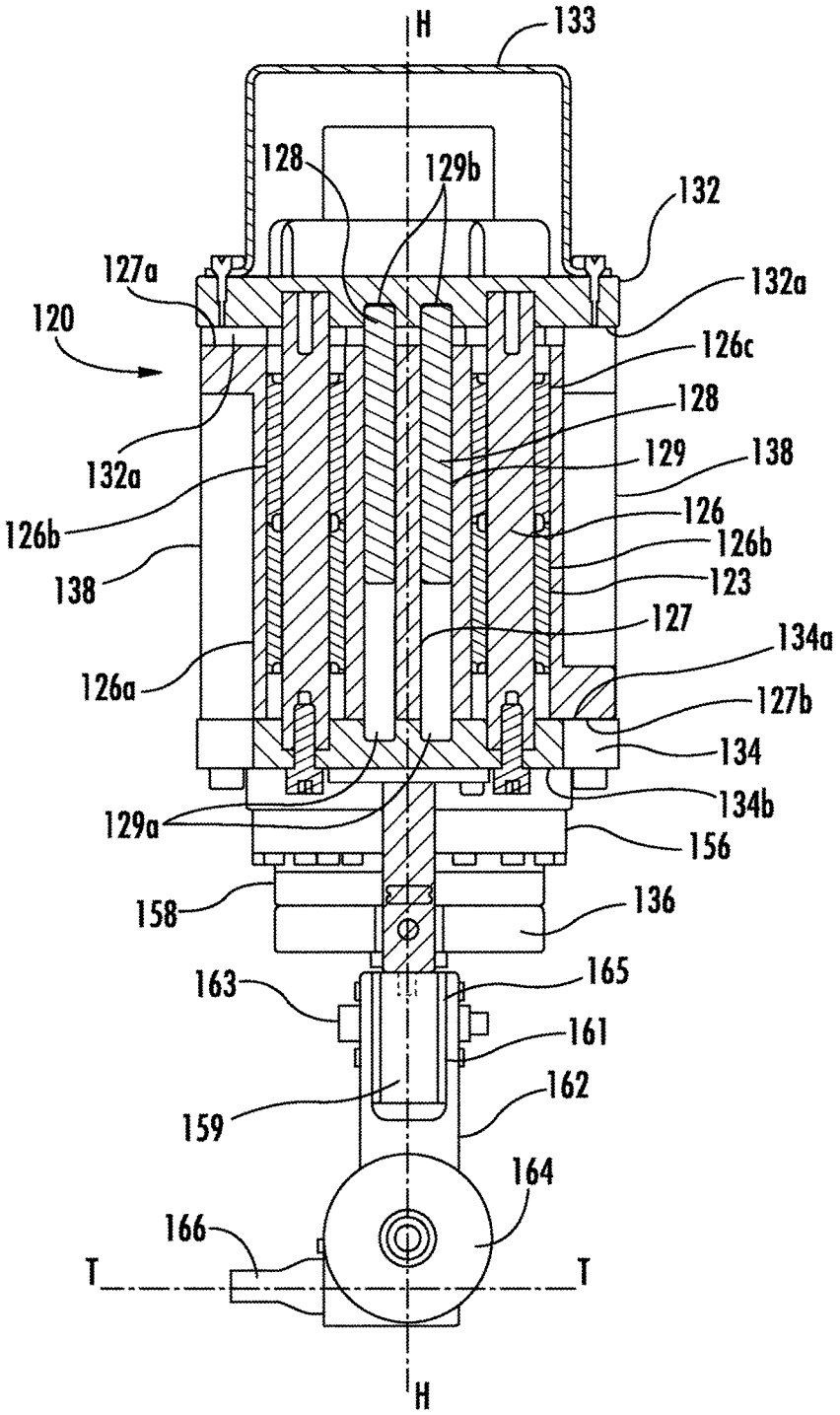
FIG. 8 is a cross-sectional view taken along the section line 8-8 of FIG. 7.

Referring now to FIGS. 5-8, the steering roller head 100 can be configured as a push roller head (FIGS. 5 and 6) or a pull roller head (FIGS. 7 and 8). As detailed above, the biasing unit 120 is laterally positioned between the mounting flange 110 and the housing 130. The biasing unit 120 is vertically disposed between the top plate 132 and base plate 134. The biasing unit 120 includes an insert 127 that has a top stopping surface 127*a* and a bottom stopping surface 127*b* that arrest travel of the housing 130 parallel to the longitudinal axis H-H. Referring to FIGS. 5 and 6 when the steering roller head is in the push configuration the top stopping surface 127*a* of the insert 127 abuts the bottom surface 132*a* of the top plate 132 to arrest travel of the housing. The bottom stopping surface 127*b* arrests the housing 130 in the direction of travel or compliance of the roller head 100 during the compression of the housing 130 during roller hemming. When in a free state (no compression of the roller head) the top stopping surface 127*a* of the insert 127 is in contact with the bottom surface 132*a* of the top plate 132 as well as the bottom stopping surface 127*b* of the insert 127 is disposed with a gap to the top surface 134*a* of the base plate 134. The insert 127 defines passages 123 that are parallel to the housing axis H-H. The biasing unit 120 includes linear bushings 126*b* which are disposed within the passages 123 to limit translation of the insert 127 to sliding translation to parallel with the housing axis H-H. The guide shafts 126*a* can be supported by the top plate 132 and base plate 134. The guide shafts 126*a* and linear bushings 126*b* provide for translation of the housing 130 along the housing axis H-H.

The insert 127 also defines one or more holes 129 parallel to the housing axis H-H. The biasing unit 120 includes a spring 128 disposed within each of the holes 129 which bias the housing 130 parallel to the housing axis H-H. The base plate 134 defines corresponding holes 129*a* that receive the springs 128. In the push configuration, the roller (e.g., roller 164 or roller 166) is positioned between the base plate 134 and the work piece such that the roller is biased towards the housing 130.

Referring now to FIGS. 7 and 8, the steering roller head 100 is in a pull configuration such that the steering roller head 100 is configured as a pull roller head. The biasing unit 120 made up of the insert 127, guide shafts 126*a*, linear bushings 126*b*, and springs 128 is inverted within the housing 130 as a combined assembly to convert the steering roller head 100 from the push configuration to the pull configuration. In the pull configuration, the top stopping surface 127*a* of the insert 127 has a gap to the bottom surface 132*a* of the top plate 132. The top stopping surface 127*a* arrests the housing 130 in the direction of travel or compliance (opposite that of the push configuration) of the roller head 100 during the extension of the housing away from the mounting flange 110 during roller hemming. The bottom stopping surface 127*b* of the insert 127 abuts the top surface 134*a* of the base plate 134 to arrest travel of the housing. When in the free state (no compression of the roller head) the bottom stopping surface 127*b* of the insert 127 is in contact with the top surface 134*a* of the base plate 134. The guide shafts 126*a* and linear bushings 126*b* are orientated the same as in the push head configuration within the insert 127. The complete biasing unit 120 with guide shafts 126*a*, linear bushings 126*b*, and springs 128 are assembled inverted to that of the pull roller head. With the insert 127 in the inverted orientation the springs 128 are disposed into the holes 129*b* in the top plate 132. In the pull configuration, the roller (e.g., roller 164 or roller 166) is positioned between the base plate 134 and the work piece such that the roller is biased away from the housing 130.

It is contemplated that the steering roller head 100 can be converted from the push configuration to the pull configuration, or vice versa, by disassembling the biasing unit 120, rotating the insert 127, with the springs 128, and the guide shafts 126*a* and reassembling the biasing unit 120 between the top and base plates 132 and 134.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A steering roller head comprising:

a housing defining a longitudinal axis of the steering roller head; a motor mounted within the housing and including a drive shaft; and a roller package operably associated with the motor, wherein the motor is configured to rotate the driveshaft to provide an input to drive an output to a roller mounting plate connected to the roller package through a mounting shaft that rotates the roller package about the longitudinal axis of the steering roller head.

2. The steering roller head according to claim 1, further comprising a mounting flange operably coupled to the housing, the mounting flange offset from the longitudinal axis.

3. The steering roller head according to claim 2, wherein the mounting flange includes a mounting surface that defines a mounting plane, the mounting plane defining a mounting angle with the longitudinal axis.

4. The steering roller head according to claim 3, wherein the mounting angle is in a range of about 30° to about 60°.

5. The steering roller head according to claim 2, wherein the mounting flange is laterally offset from the longitudinal axis.

6. The steering roller head according to claim 2, further comprising a biasing unit, the mounting flange attached to the biasing unit and the biasing unit attached to the housing.

7. The steering roller head according to claim 6, wherein the steering roller head has a push configuration wherein the biasing unit urges the roller package in a direction away from the housing along the longitudinal axis, and wherein the steering roller head has a pull configuration wherein the biasing unit urges the roller package toward the housing along the longitudinal axis.

8. The steering roller head according to claim 7, wherein the biasing unit includes longitudinal guides and a slidable insert that houses the longitudinal guides, the insert is disposed between a top plate and a base plate of the housing.

9. The steering roller head according to claim 8, wherein the biasing unit includes a stop surface that abuts the top plate to arrest movement of the biasing unit parallel to the longitudinal axis in the push configuration.

10. The steering roller head according to claim 8, wherein the biasing unit includes a stop surface that abuts the base plate to arrest movement of the biasing unit parallel to the longitudinal axis in the pull configuration.

11. The steering roller head according to claim 8, wherein the biasing unit includes springs, wherein in the push configuration the insert is orientated to position the springs between the insert and the base plate, and wherein in the pull configuration the insert orientated to position the springs between the insert and the top plate.

12. The steering roller head according to claim 8, wherein the insert defines holes that receive springs, the insert being reversible to change the configuration of steering roller head.

13. The steering roller head according to claim 1, further comprising a gearbox secured to the housing, the gearbox receiving input from the drive shaft of the motor and including an output shaft rotatably fixed to the roller package through the roller mounting plate.

14. The steering roller head according to claim 13, wherein the gearbox is configured to resist axial and transverse forces experienced by the roller package during roller hemming.

15. A robot for roller hemming, the robot comprising:

a base;

an arm including a first link and a second link, the first link operably coupled to the base and the second link operably associated with the first link, the second link including a tool coupler; and a steering roller head coupled to the tool coupler, the steering roller head including:

a housing defining a longitudinal axis of the steering roller head;

a motor mounted within the housing and including a drive shaft; and a roller package operably associated with the motor, wherein the motor is configured to rotate the drive shaft to provide an input into an output shaft rotatably fixed to the roller mounting plate that is coupled to the roller package through a mounting shaft such that rotation of the drive shaft affects rotation of the roller package about the longitudinal axis of the steering roller head.

16. The robot according to claim 15, wherein the arm is configured to move the steering roller head in six degrees of freedom, and wherein the motor is configured to rotate the roller package in a seventh degree of freedom.

17. The robot according to claim 15, further comprising a robot controller configured to control movement of the arm, and wherein the motor includes a motor controller configured to control rotation of the roller package relative to the housing.

18. The robot according to claim 17, wherein the motor controller is integrated with the robot controller.

19. A steering rover head comprising:

a housing defining a longitudinal axis of the steering roller head;

a motor mounted within the housing and including a drive shaft;

a package operably associated with the motor, wherein rotation of the drive shaft affects rotation of the roller package about the longitudinal axis of the steering roller head;

a gearbox secured to the housing, the gearbox receiving input from the drive shaft of the motor and including an output shaft rotatably fixed to the roller mounting plate that extends to the roller package through a mounting shaft, the gearbox configured to resist axial and transverse forces experienced by the roller package during roller hemming.

* * * * *